US006446759B1

(12) United States Patent
Kulak et al.

(10) Patent No.: US 6,446,759 B1
(45) Date of Patent: Sep. 10, 2002

(54) DOOR COUPLER AND LATCH SYSTEM FOR ELEVATOR CAR AND LANDING DOORS

(75) Inventors: Richard E. Kulak, Bristol, CT (US); Michael J. Tracey, Cromwell, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/681,807

(22) Filed: Jun. 8, 2001

(51) Int. Cl.[7] ..... B66B 13/06; B66B 13/12; B66B 13/20

(52) U.S. Cl. ..... 187/330; 187/331; 187/335; 187/319; 49/120

(58) Field of Search ..... 187/309, 313, 187/319, 330, 334, 335; 49/116, 120

(56) References Cited

U.S. PATENT DOCUMENTS

| | | | | | |
|---|---|---|---|---|---|
| 1,326,440 | A | * | 12/1919 | Chaudoir | 187/330 |
| 3,605,952 | A | * | 9/1971 | Lusti | 187/319 |
| 4,947,964 | A | * | 8/1990 | Husmann | 187/319 |
| 5,819,877 | A | * | 10/1998 | Rivera et al. | 187/335 X |
| 5,950,766 | A | * | 9/1999 | Oberleitner | 187/330 |
| 6,021,871 | A | * | 2/2000 | Grabner | 187/335 |
| 6,164,417 | A | | 12/2000 | Oberleitner | 187/319 |
| 6,340,073 | B1 | * | 1/2002 | Lee et al. | 187/309 |

* cited by examiner

*Primary Examiner*—Eileen D. Lillis
*Assistant Examiner*—Thuy V. Tran

(57) ABSTRACT

A coupling (8) for engaging an elevator car door (16) and a landing door (20) includes a fixed vane (36) and a movable vane (38). The movable vane is positioned by an engagement link (42) in response to movement of the car door (16) and the presence or absence of a corresponding landing door roller (28).

6 Claims, 5 Drawing Sheets

FIG.7
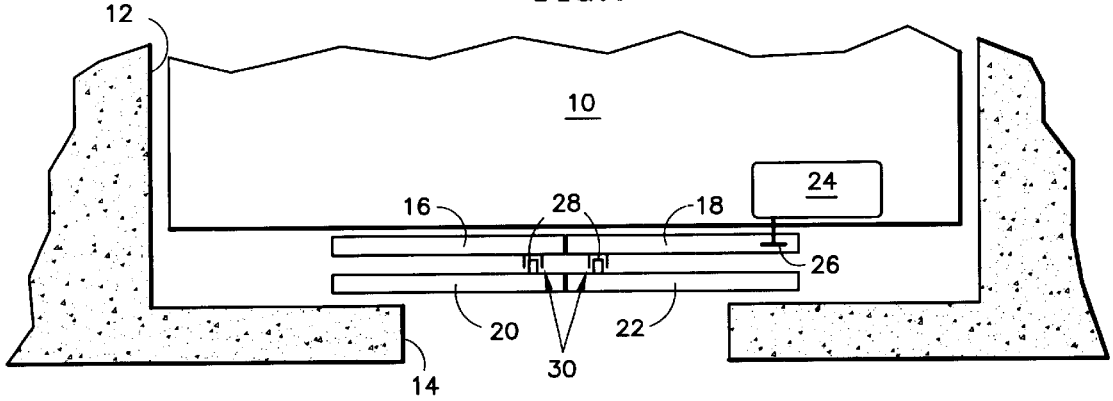
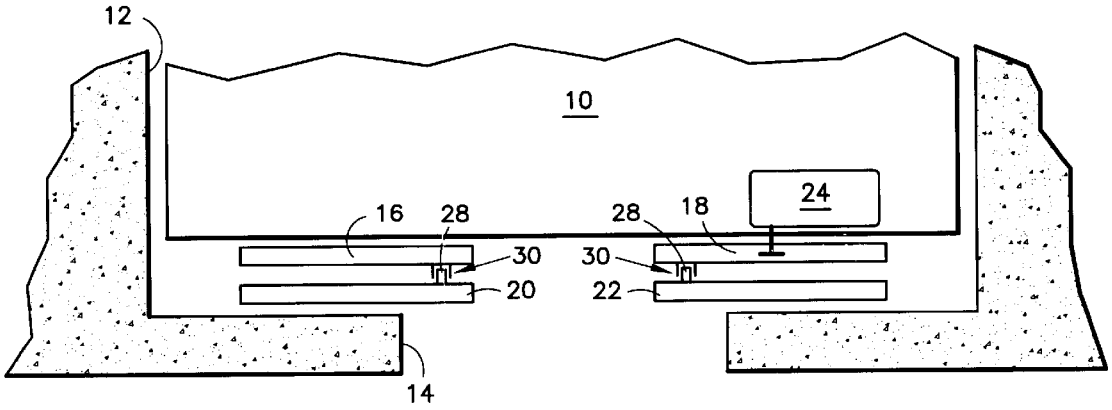
FIG.8

DOOR COUPLER AND LATCH SYSTEM FOR ELEVATOR CAR AND LANDING DOORS

BACKGROUND OF INVENTION

The present invention relates to a method and means for engaging elevator car and landing doors.

In a typical elevator or lift installation, the vertically moving elevator car is positioned so as to align its entrance with corresponding openings at a plurality of landings in a multi-floor building. Modern installations typically have one or more horizontally sliding doors disposal on the elevator car and one set disposed on each of the landing floors, all of which remain closed during vertical movement of the elevator.

Upon arrival of the elevator car at a floor or landing to be serviced, a door opening mechanism is activated which drives the elevator car doors horizontally for permitting access to the elevator car. In typical installations today, one or more vanes, projecting from the surface of the elevator car door in the direction of the adjacent landing door, engage various structures, such as vanes, rollers or other protrusions projecting from the landing door, for also driving the landing door horizontally, thereby permitting passengers to traverse between the car and the serviced landing.

Code developments have long required the landing doors to remain fastened securely against unauthorized entry unless an elevator car is positioned so as to correspond with the landing. Likewise, recent code developments in certain countries have required that the elevator car door remain latched against manual movement unless the car is positioned so as to register with a landing. Various mechanisms and systems have been proposed in the prior art to secure and unsecure landing and elevator car doors as the elevator car traverses the elevator hoistway. Various mechanical and electrical interlock systems used to date have the disadvantage of being complex, and subject to malfunction and/or frequent service requirements. As will be appreciated by those skilled in the art, failure or malfunction may lead to the potential for a code violation or, even more seriously, shut down of the operation of the elevator or entrapment of the passenger.

What is needed is a simple, effective mechanical system for appropriately engaging the elevator landing doors and elevator car doors at a serviced landing, while securing the elevator car doors against inappropriate opening when the elevator car is not correctly positioned within the hoistway.

SUMMARY OF INVENTION

It is therefor an object of the present invention to provide a simple mechanical system for engaging the elevator car door and landing doors when the elevator is positioned at one of the landings, and, additionally, for securing the elevator doors when the elevator is intermediate the landings.

According to the present invention, a mechanical door coupling is provided on the exterior surface of an elevator door. The coupling includes a first fixed vane extending longitudinally vertically, is fixed to the elevator door and horizontally movable therewith. The coupling according to the present invention also includes a second vane, mounted to the door by a pair of parallel pivoted links. The second movable vane is arranged adjacent the first vane and parallel thereto, and includes a deterrent hook member disposed at one end thereof. The second vane is positioned by an engagement link, pivotally secured to the second vane and including an engagement roller contacting to a camway fixed to the elevator car. The engagement link includes an engagement hook, which engages an engagement striker when the elevator door and corresponding hallway door are in full engagement.

In operation, the coupling according to the present invention maintains the fixed and second vanes spaced apart when the elevator car doors are fully closed to permit the vanes and elevator to easily pass the landing door rollers during movement of the elevator car. When the car is positioned in registration with a landing, the initial opening movement of the elevator door traps the landing door rollers between vanes, maintaining the vanes at a fixed horizontal distance and causing the engagement hook to engage the engagement striker, thereby securely trapping the landing door rollers and locking the elevator and landing doors laterally for sliding operation.

During periods in which the elevator is between landings, the system according to the present invention acts as an evacuation deterrent in the event a passenger attempts to slide the elevator door open. The movement of the door, combined with the action of the engagement link roller and camway cause the second vane to move closer to the first vane, in turn causing the deterrent hook secured to the second vane to engage the deterrent striker secured to the elevator car. The engagement of these two elements blocks the elevator door from further motion in the horizontally opened direction.

BRIEF DESCRIPTION OF DRAWINGS

FIG. 7 shows a plan view of an elevator car in a hoistway.

FIG. 8 is a plan view illustrating the car and lobby doors in a partly opened position.

DETAILED DESCRIPTION

Figure 2:
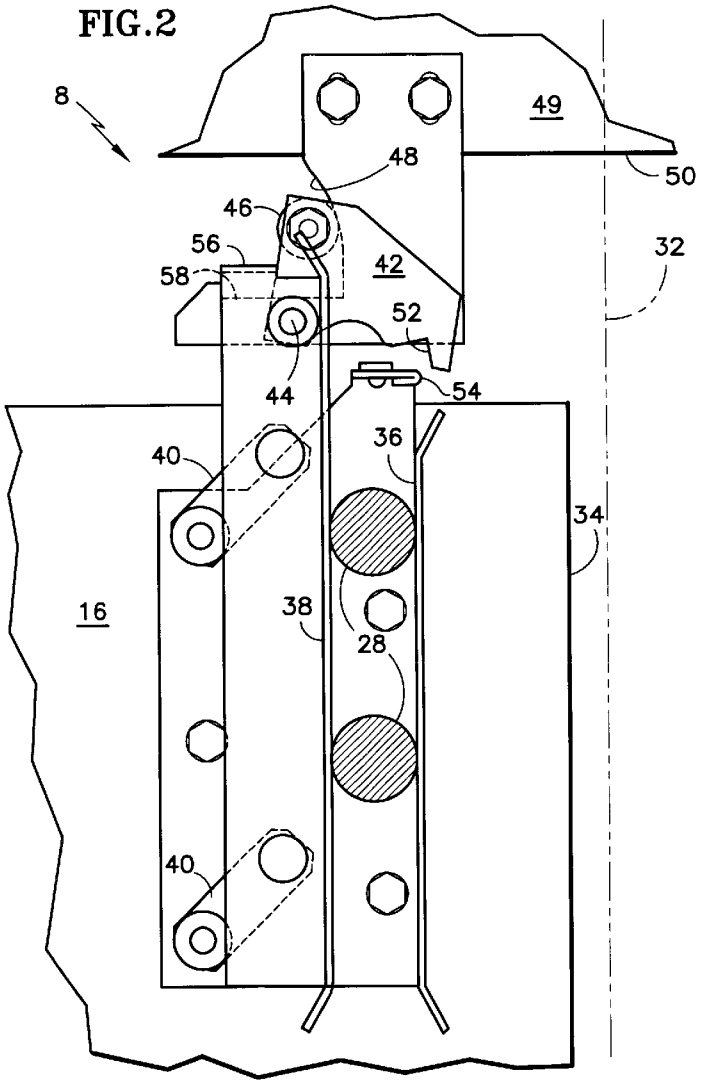
FIG. 2 shows the door coupling positioned at a landing and engaged with the landing door rollers.

Referring now to the drawing figures, and in particular to FIGS. 7 and 8, a typical elevator installation in which a coupling according to the present invention may be used will be described. FIG. 7 shows a plan view of an elevator car 10 disposed in a vertical hoistway 12 and positioned so as to correspond to a landing having a lobby opening 14. Elevator car doors 16, 18 are shown in correspondence with laterally sliding lobby doors 20, 22. As is typical in such installations, the elevator doors 16, 18 are actuated by a door opener 24 shown here disposed atop the elevator car 10 and having a drive linkage, or the like 26. FIG. 8 shows the arrangement of FIG. 7, wherein the elevator doors 16, 18 and lobby doors 20, 22 are shown in a partially opened condition. In each figure, a coupling 30 disposed on the elevator doors 16, 18 is shown engaged with a corresponding protrusion 28 which extends inward from the landing doors 20, 22. The protrusions 28 may be any sort of raised boss, bumper, rod, or, preferably a roller, and which provides a simple and effective means for enabling the elevator door couplers 30 to engage and move the landing doors 20, 22. As will be appreciated by those skilled in the art, it is desirable that the door coupler 30 firmly grip the landing door protrusion 28 when the elevator and landing doors are operated, and also desirable that the coupler 30 completely release said protrusions 28 and maintain sufficient running clearance as the elevator moves vertically through the hoistway 12.

Figure 1:
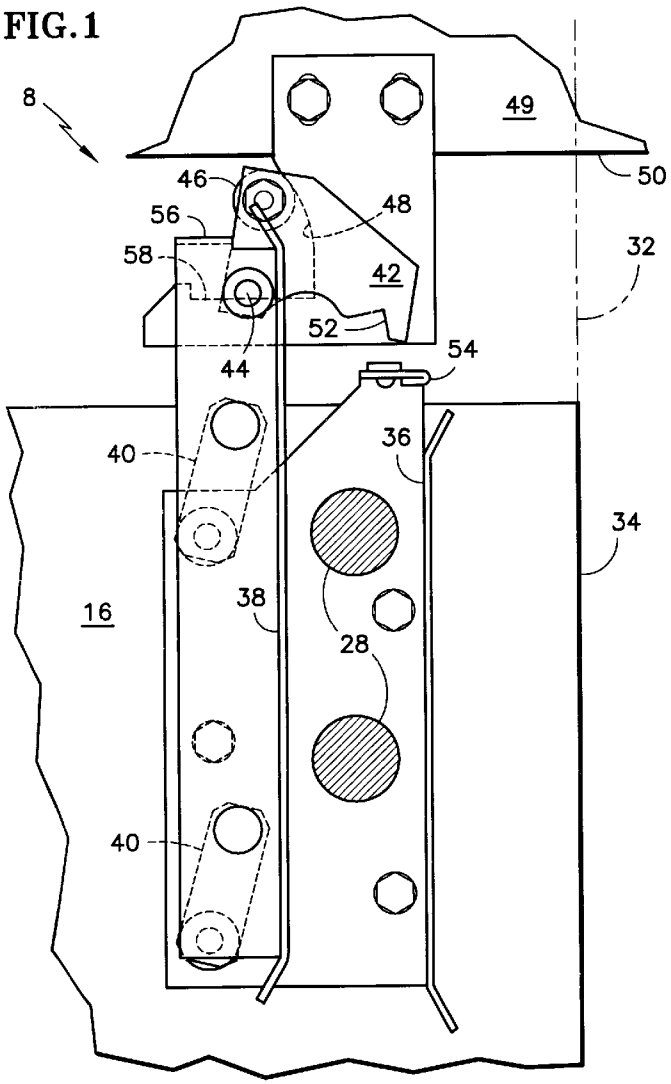
FIG. 1 shows the door coupling according to the present invention with the door in the fully closed position.

Referring now to FIG. 1, an embodiment of the coupler according to the present invention will be described in detail. FIG. 1 shows the coupler 8 as it would appear viewed in elevation when the corresponding elevator car door 16 is in the fully closed position. For FIGS. 1 to 6, reference line 32 represents the position of the leading edge 34 of the car door 16 when fully closed.

The coupler 8 comprises a fixed vane 36 secured to the car door 16 and extending longitudinally vertically with respect thereto. The first vane 36 is positioned preferably relatively near the leading edge 34 of the door 16, and proximate the position of the landing door rollers 28 when the landing door is also fully closed. A second vane 38, also extending longitudinally vertically in parallel with the first vane 36, is, in this position, spaced laterally therefrom. The second vane 38 is supported relative to the door 16 by a pair of pivoting links 40 which enable the vane 38 to move both horizontally and vertically relative to the door 16, while at all times remaining parallel to the first vane 36.

Shown in this embodiment attached to the upper end of the second vane 38 is an engagement link 42 pivotally attached 44 to the second vane 38. Engagement link 42 further includes a roller 46 which is received by camway 48 secured to the lintel 49 of the door opening 50 in the elevator car 10.

The engagement link 42 also includes an engagement hook 52, the function of which shall be explained in greater detail below.

When disposed in the configuration as shown in FIG. 1, the coupler according to the present invention is well adapted to permit vertical movement of the elevator car 10 within the hoistway 12. First and second vanes 36, 38 are well spaced apart and permit the landing door rollers 28 of the respective landings to be passed easily without danger of interference or contact.

Figure 3:
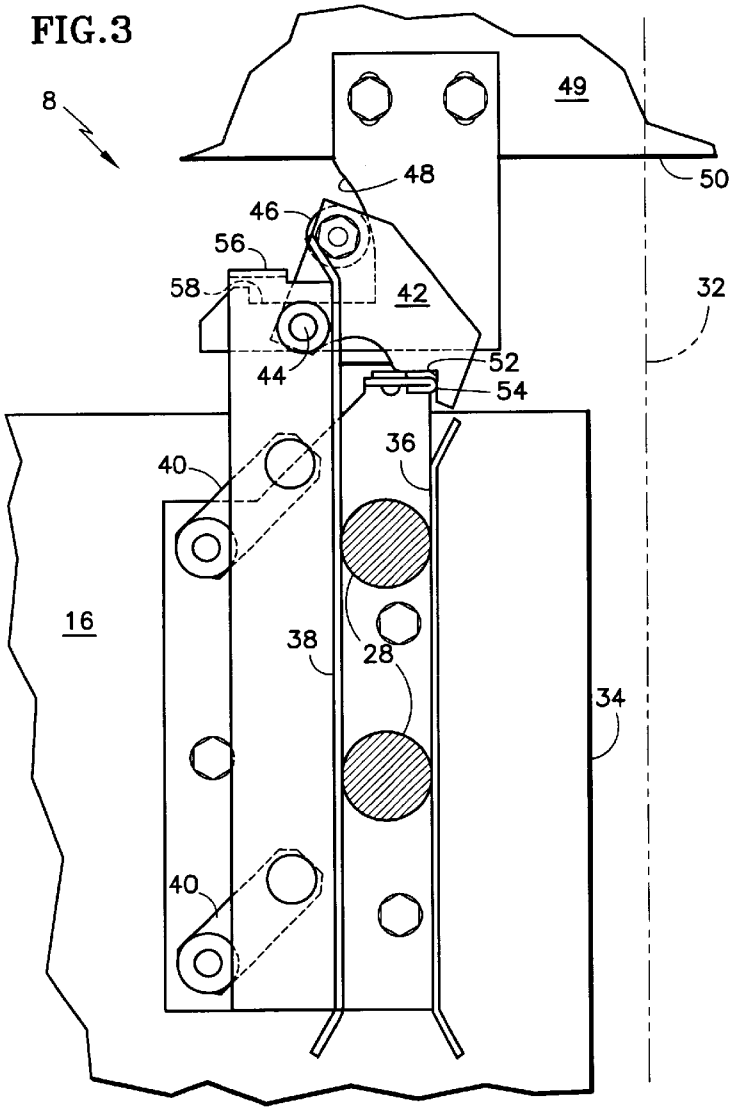
FIG. 3 shows the door coupling fully engaged with the landing door rollers and in its fully engaged configuration.
Figure 5:
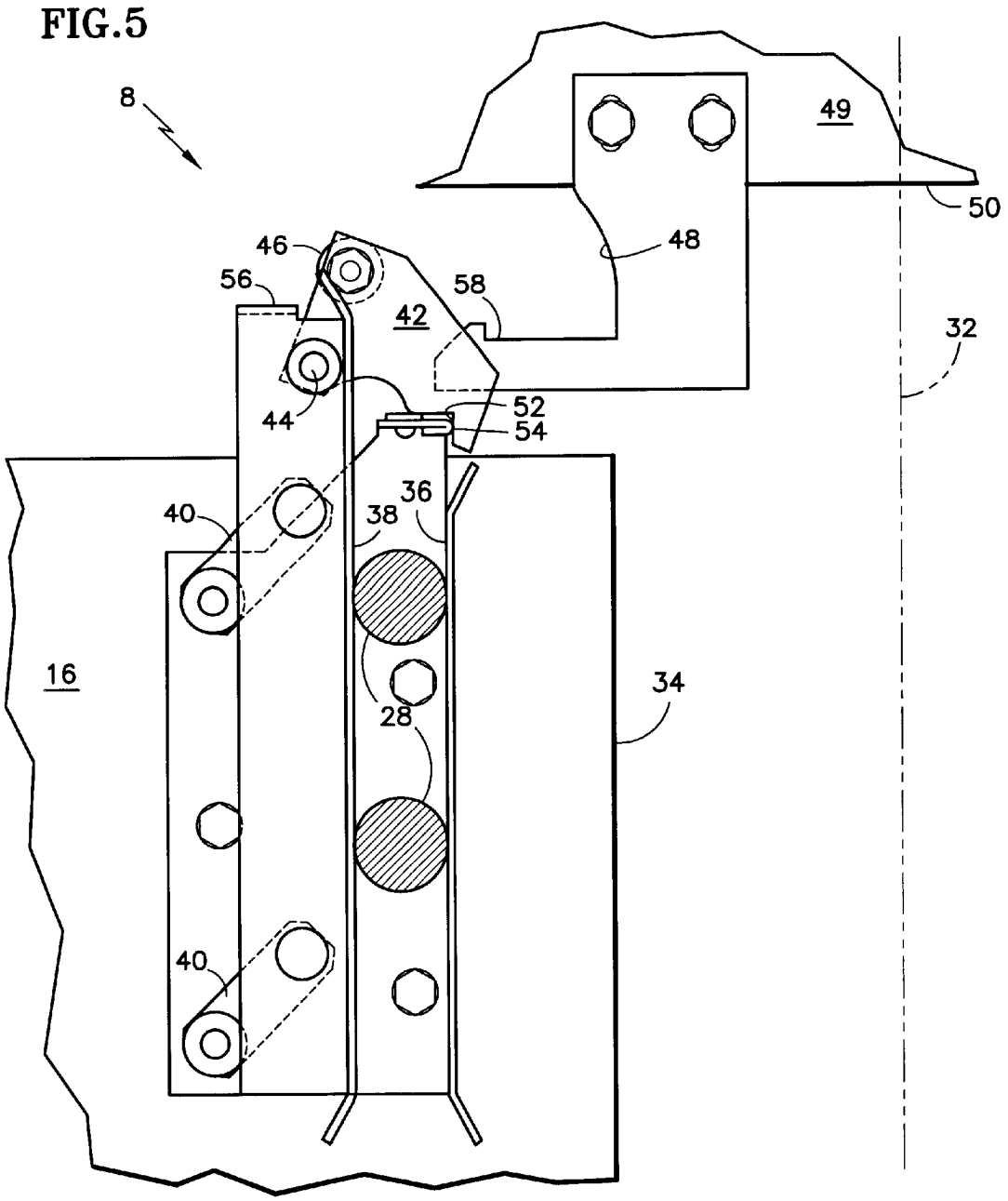
FIG. 5 shows the door coupling according to the present invention in its fully engaged mode as the door is retracted into an opened position.

By contrast, FIG. 2 shows the coupling according to the present invention as it would appear during normal opening operation of the elevator door 16 when positioned in registration with a landing door (not shown in this figure). As can be seen in FIG. 2, the leading edge 34 of the elevator door 16 has been retracted a small distance from its closed position 32. By the combined action of the links 40, the engagement link roller 46, and camway 48. The second vane 38 has moved slightly downward and toward fixed vane 36 to contact the landing door rollers 28. As will be appreciated by a review of FIG. 2, further motion of the door 16 in the opening direction, i.e., to the left, will result in the landing door rollers 28, and hence the landing door, being also moved leftward and open. FIG. 3 shows the coupler 8 with the door 16 opened slightly further. In this position, the engagement link 42, now pivoting clockwise about pivot 44 as permitted by the interaction of roller 46 and camway 48, moves to engage the hook end 52 with an engagement striker plate 54 secured to the elevator door 16 and projecting perpendicular thereto. In this configuration, the coupling 8 according to the present invention has fully engaged the landing door rollers 28, and firmly trapped both between the first and second vanes 36, 38. The interaction of the engagement hook 52 and engagement striker 54 prevents the lateral movement of the second vane 38 thereby forcing the landing door rollers, and hence the landing door 20 to move laterally in unison with the elevator car door 16. FIG. 5 shows another view of the coupling as the door 16 has been moved even further into the opened position.

It should be noted that, although illustrated here as having the landing door roller or rollers 28 located between vanes 36, 38, the coupling according to the present invention is equally capable of operating as described above if the vanes 36, 38 were positioned laterally between a pair of landing door rollers. In this alternative embodiment (not shown), the movable vane would move apart from the fixed vane during door operation, contacting the corresponding roller and being engaged by the engagement link in a spread apart relationship with the fixed vane.

It will be appreciated that, upon closing of the elevator car and landing doors 16, 20, the engagement link roller 46 will, upon contacting the camway 48, rotate the engagement link 42 and lift the engagement hook 52 from the engagement striker plate 54, releasing the second vane 38 and lifting it upward and away from the fixed vane 36 to return to the configuration as shown in FIG. 1.

Figure 4:
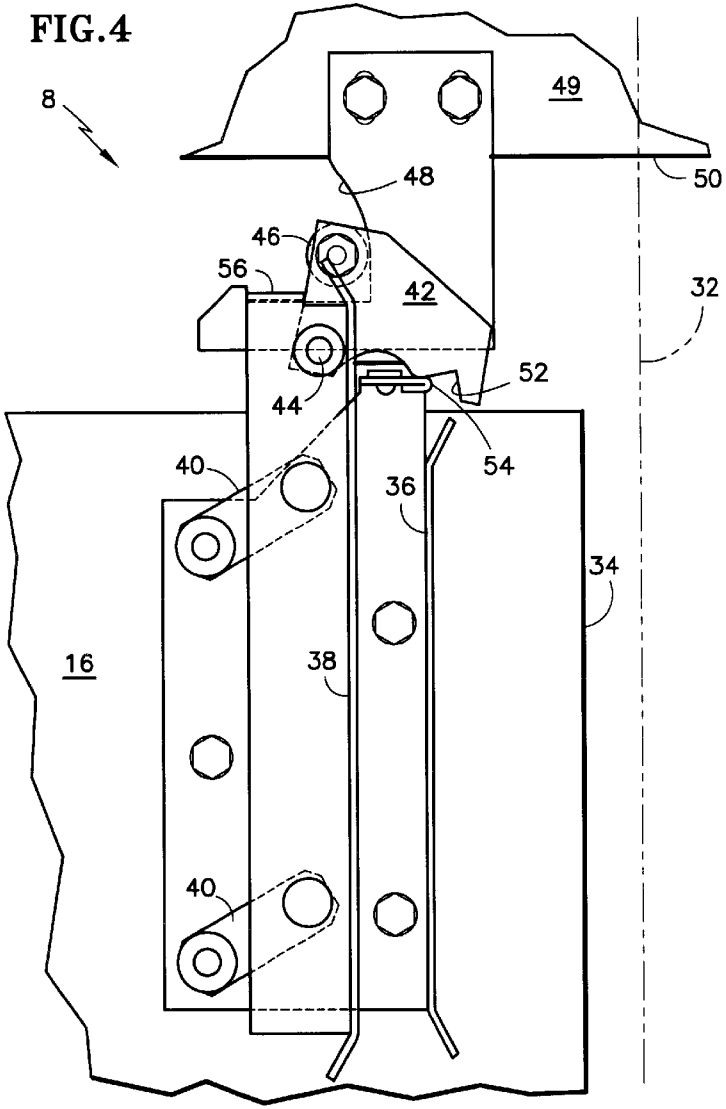
FIG. 4 shows the operation of the door coupling in its deterrent mode, whereby the elevator car doors are restrained against opening between landings.

FIG. 4 shows the coupling 8 according to the present invention operating in an evacuation deterrent mode whereby the coupling 8 prevents the inadvertent opening of the elevator door 16 when the elevator is disposed intermediate landings. Such unauthorized opening of the elevator car door 16 may occur should a passenger attempt to pull the door 16 laterally, etc. In the embodiment of the present invention as shown in FIG. 4, elevator car door 16 has been urged into a slightly opened condition by moving slightly to the left away from the closed position 32. As can be seen by viewing FIG. 4, movable second link 38 moves downward and toward fixed link 36 as the pivoting links 40 rotate clockwise and the engagement link roller 46 moves down the camway 48. As, in this configuration, there are no landing door rollers 28 disposed between the vanes 36, 38, the second vane 38 is permitted to approach the fixed vane 36 much more closely, as a consequence, the second vane 38 drops a greater distance in the vertical direction.

This vertical drop is sufficient to permit a deterrent hook 56 shown fixed to the upper end of the second vane 38 to come into engagement with a deterrent striker 58 secured to the elevator car door opening lintel 49. As will be appreciated, the engagement of the deterrent hook 56 and the deterrent striker 58 firmly locks the elevator door 16 against further opening movement, thereby preventing unauthorized access from the elevator car interior into the hoistway.

Figure 6:
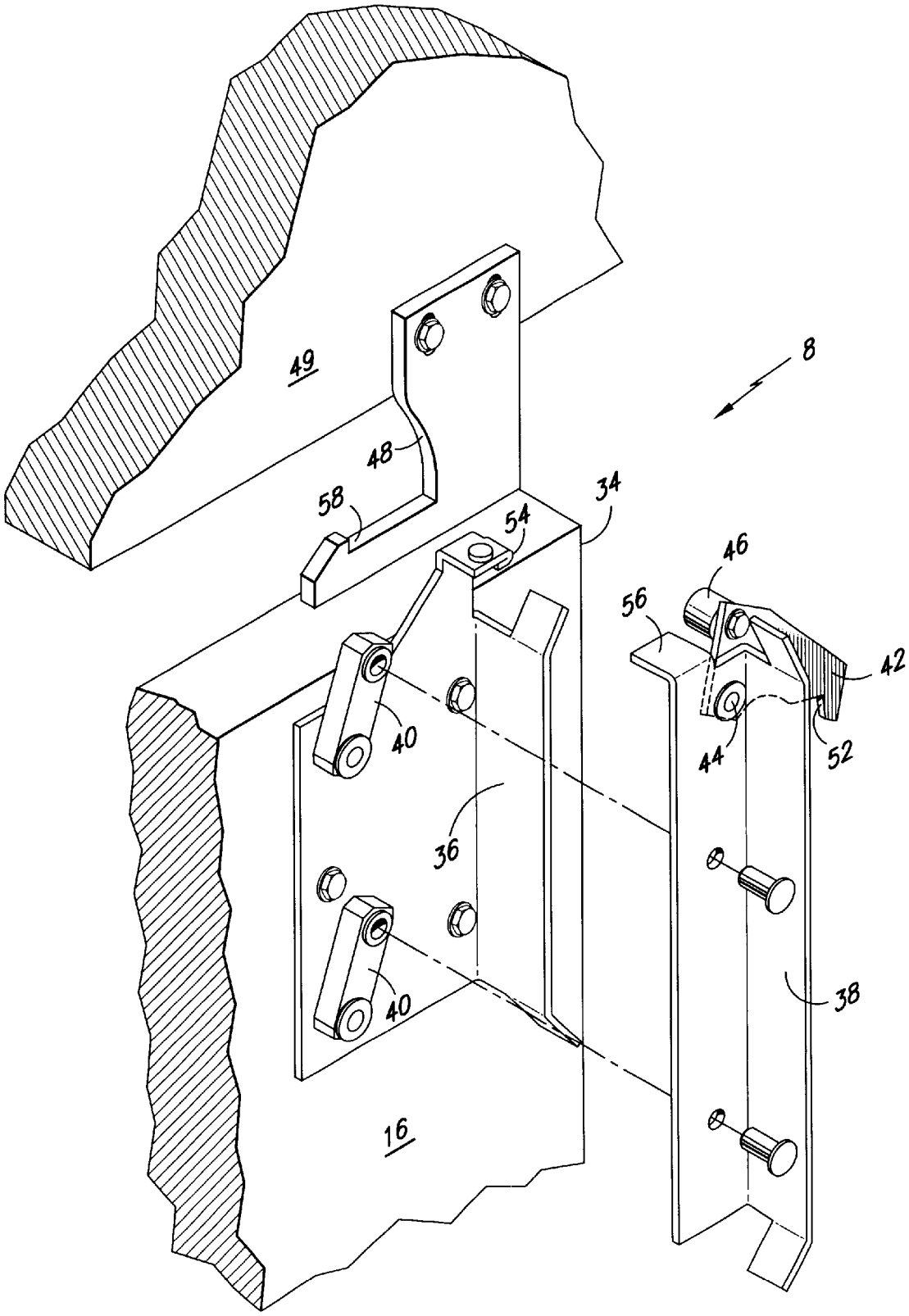
FIG. 6 shows the preferred embodiment of the door coupling in an exploded view illustrating the individual elements thereof.

FIG. 6 shows an assembly diagram of the coupling 8 according to the present invention illustrating the arrangement and orientation of the individual elements.

The coupler according to the present invention provides a simple mechanical means for providing firm engagement between the elevator car door and landing door when the elevator door is positioned in registration with the landing door opening, and, if necessary, an effective mechanical means for latching the elevator car door against being opened inappropriately when the elevator is not located adjacent a landing opening.

Both these and other objects and advantages of the coupling according to the present invention will become obvious to those skilled in the art upon review of the foregoing specification and the appending drawing figures, which should be interpreted as being illustrative of the features of the coupler according to the present invention and not as setting forth any limitation thereto, such being defined solely by the claims appended hereto.

What is claimed is:

1. A coupling for engaging a laterally movable door of an elevator car to a door of a landing when the car door is positioned in registration with said landing, comprising:

a first elongated vane, supportably attached to the car door and movable therewith, said first vane extending longitudinally vertically;

a second elongated vane, longitudinally oriented parallel to the first vane, said second vane mounted to the car door by a pair of pivoted link arms, whereby said second vane is movable in a plane parallel to the car door;

an engagement link, pivotally attached to said second vane the engagement link further including an engagement hook integral therewith;

means, responsive to the lateral position of the car door, for positioning said second vane and engagement link, the positioning means including a camway secured to the elevator car and a roller, secured to the engagement link, the roller contacting the camway when the car door is proximate a closed position;

an engagement striker, fixed to the car door, for receiving and engaging the engagement hook during operation of the car door and landing door; and means for securing the car door in a closed position when the elevator car is not positioned in registration with a landing.

2. The coupling as recited in claim 1, wherein the positioning means is adapted to displace said second vane laterally away from said first vane when the car door is in a closed position, and wherein said positioning means is further adapted to permit said second vane to move closer to said first vane when the car door is moved from the closed position.

3. The coupling as recited in claim 1, wherein the engagement hook and engagement striker, when engaged, hold said second vane at a fixed distance from said first vane.

4. The coupling as recited in claim 1, further comprising a deterrent latch operable to prevent movement of the car door when the elevator car is not positioned in registration with a landing door, said latch including a deterrent hook secured to said second vane and movable therewith; and a deterrent striker secured to the elevator car, and wherein the positioning means is adapted to position the deterrent hook to engage the deterrent striker upon movement of the car door from a closed position during such period when the elevator car is not in registration with a landing.

5. A coupling for engaging a laterally movable door of an elevator car to a door of a landing when the car door is positioned in registration with said landing, comprising:

a first elongated vane, supportably attached to the car door and movable therewith, said first vane extending longitudinally vertically;

a second elongated vane, longitudinally oriented parallel to the first vane, said second vane mounted to the car door by a pair of pivoted link arms, whereby said second vane is movable in a plane parallel to the car door;

an engagement link, pivotally attached to said second vane, the engagement link further including an engagement hook integral therewith; and means, responsive to the lateral position of the car door, for positioning said second vane and engagement link, the positioning means including:

a roller mounted to the engagement link and adapted to engage a camway secured to the elevator car, said roller and camway operable to position the engagement link and said second vane during at least a portion of the movement of the car door;

an engagement striker, fixed to the car door, for receiving and engaging the engagement hook during operation of the car door and landing door; and a deterrent latch, operable to prevent movement of the car door when the elevator car is not positioned in registration with a landing door, said latch including a deterrent hook, secured to said second vane and movable therewith; and a deterrent striker, secured to the elevator car, and wherein the positioning means is adapted to position the deterrent hook to engage the deterrent striker upon movement of the car door from a closed position during such period when the elevator car is not in registration with a landing.

6. The coupling as recited in claim 5, wherein the camway is integral with the deterrent striker.

* * * * *